US009297055B2

(12) United States Patent
Lindsley

(10) Patent No.: US 9,297,055 B2
(45) Date of Patent: Mar. 29, 2016

(54) COMPOSITIONS AND METHODS FOR IMPROVED DIMENSIONAL CONTROL IN FERROUS POWDER METALLURGY APPLICATIONS

(75) Inventor: Bruce Lindsley, Cinnaminson, NJ (US)

(73) Assignee: Hoeganaes Corporation, Cinnaminson, NJ (US)

( * ) Notice: Subject to any disclaimer, the term of this patent is extended or adjusted under 35 U.S.C. 154(b) by 1091 days.

(21) Appl. No.: 13/109,335

(22) Filed: May 17, 2011

(65) Prior Publication Data

US 2011/0283832 A1 Nov. 24, 2011

Related U.S. Application Data

(60) Provisional application No. 61/346,259, filed on May 19, 2010.

(51) Int. Cl.
*B22F 1/00* (2006.01)
*C22C 33/02* (2006.01)

(52) U.S. Cl.
CPC ..... *C22C 33/0264* (2013.01); *B22F 1/0003* (2013.01)

(58) Field of Classification Search
CPC ..... B22F 2301/35; B22F 2302/40; B22F 2303/01; B22F 2303/05; B22F 2303/15; B22F 2999/00; C22C 38/16
USPC ..... 75/228–246, 255, 252; 148/332; 420/26, 39, 45, 58, 60, 76, 89
See application file for complete search history.

(56) References Cited

U.S. PATENT DOCUMENTS

| | | | | |
|---|---|---|---|---|
| 5,330,792 | A | 7/1994 | Johnson et al. | |
| 5,368,630 | A | 11/1994 | Luk | |
| 5,498,276 | A | 3/1996 | Luk | |
| 6,068,813 | A * | 5/2000 | Semel | 419/66 |
| 7,329,380 | B2 * | 2/2008 | Yu | 419/11 |
| 2003/0143097 | A1 * | 7/2003 | Nakamura et al. | 419/57 |
| 2004/0112173 | A1 * | 6/2004 | Maulik | 75/246 |

FOREIGN PATENT DOCUMENTS

| | | | | |
|---|---|---|---|---|
| GB | 1595346 | * | 8/1981 | B22F 1/00 |
| JP | 53146204 | | 12/1978 | |
| JP | 2004-520486 | | 8/2004 | |
| JP | 2006-503981 | | 2/2006 | |
| JP | 2008-266776 | | 11/2008 | |
| JP | 2009-280907 | | 12/2009 | |
| WO | 02059388 A1 | | 8/2002 | |

(Continued)

OTHER PUBLICATIONS

T. Chirkot, "Blending and Premixing of Metal Powders and Binders," Metal Powder Production and Characterization, Powder Metal Technologies and Applications, vol. 7, ASM Handbook, ASM International, 1998, pp. 102-105 (print), five (5) pages total (online printout).*

*Primary Examiner* — Scott Kastler
*Assistant Examiner* — Vanessa Luk
(74) *Attorney, Agent, or Firm* — Baker & Hostetler, LLP

(57) ABSTRACT

Iron-based powder metallurgical compositions including both iron-copper prealloy and copper powder are described. These compositions, when compacted and sintered, result in compacts having good dimensional consistency.

12 Claims, 4 Drawing Sheets

(56) References Cited

FOREIGN PATENT DOCUMENTS

| | | | | | |
|---|---|---|---|---|---|
| WO | WO 02/059388 | A1 | | 8/2002 | |
| WO | 2004038054 | A1 | | 5/2004 | |
| WO | WO 2004/038054 | A1 | | 5/2004 | |
| WO | WO 2009088771 | A2 | * | 7/2009 | ..... B22F 5/008 |

* cited by examiner

COMPOSITIONS AND METHODS FOR IMPROVED DIMENSIONAL CONTROL IN FERROUS POWDER METALLURGY APPLICATIONS

CROSS REFERENCE TO RELATED APPLICATIONS

This application claims the benefit of U.S. Provisional Application No. 61/346,259, filed May 19, 2010, the entirety of which is incorporated herein.

TECHNICAL FIELD

The present invention is directed to ferrous powder metallurgy compositions comprising elemental copper and iron-copper prealloys, which allow sintering with improved dimensional precision.

BACKGROUND

In powder metallurgy (PM), elemental copper powder is oftentimes added to iron powders, along with graphite powder, to cost-effectively improve the mechanical properties of sintered PM steel compacts. Typically, about 1.5 to about 2.5 wt. % of copper is added to the mixture to achieve these mechanical benefits.

Despite copper's advantages, it tends to cause undesirable dimensional growth in the sintered compact. Variation in size between compacted parts results in waste and increased costs. The extent of this distortion is dependent on the amount of elemental copper in the composition and the level of segregation of copper in the PM mixture. Likewise, the addition of graphite, while adding strength to the compacted part, tends to also have a significant effect on the dimensional properties of the sintered compact. Given the dimensional variability that iron-copper-graphite alloys are susceptible to, producing sintered parts having a high degree of dimensional precision is difficult using such a mixture.

FIG. 1 depicts the dimensional change of iron-based alloys including from 0 to about 2 wt. % copper, based on the weight of the alloy, and from 0.6 to about 1 wt. % of graphite, based on the weight of the alloy. As can be understood from FIG. 1, those iron-based alloys comprising about 1 wt. % copper maintained good dimensional control with respect to variations in graphite content. Unfortunately, alloys comprising 1 wt. % of copper are insufficient for most PM applications and are not widely used. Rather, alloys including about 1.5 to about 2.5 wt. %, preferably 2 wt. %, copper are widely used in the industry. Unfortunately, as can be seen from FIG. 1, alloys comprising about 1.5 and about 2 wt. % copper do not have good dimensional control with respect to variations in graphite content.

As such, PM materials that include copper and graphite, while minimizing dimensional changes, are needed.

SUMMARY

The present invention is directed to powder metallurgical compositions comprising an iron-based metallurgical powder; an iron-copper prealloy, wherein the amount of copper in the iron-copper pre-alloy is between about 2 and 10 weight percent, based on the weight of the iron-copper prealloy; and copper powder. Sintered, compacted parts made from these compositions are also described.

DETAILED DESCRIPTION OF ILLUSTRATIVE EMBODIMENTS

Figure 1:
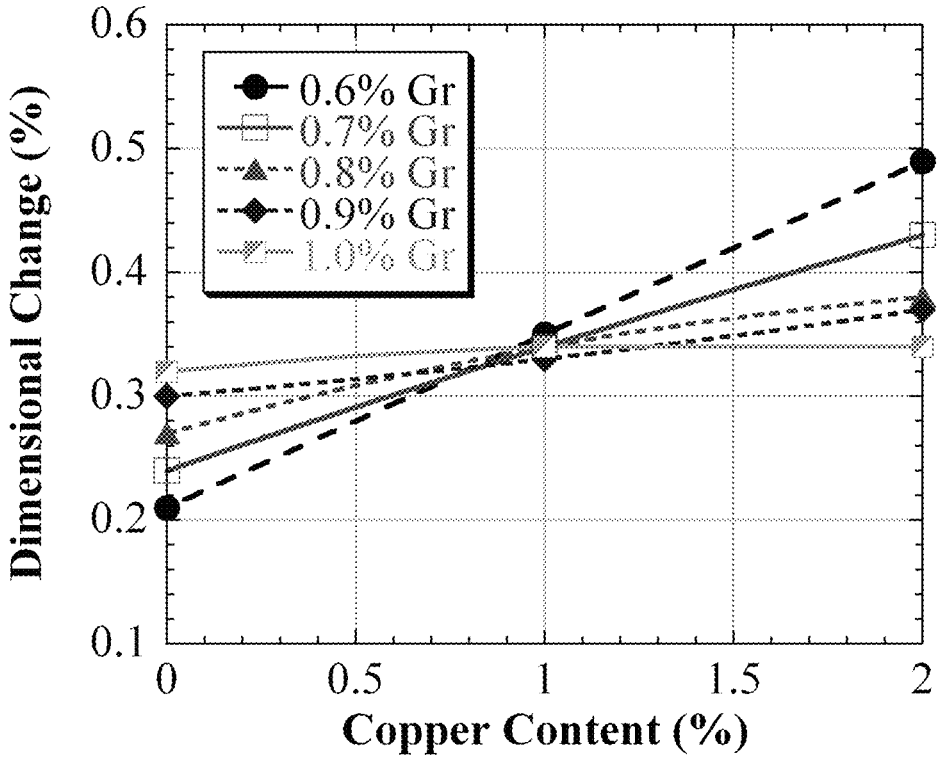
FIG. 1 depicts the effect of elemental copper and graphite content on dimensional changes of Fe—Cu—C alloys.

It has heretofore been discovered that PM compositions comprising copper powder, preferably elemental copper powder, and an iron-copper prealloy as the sources of copper in the PM composition, exhibit good dimensional control. Moreover, good dimensional control is maintained with varying graphite content in the composition.

The present invention is directed to powder metallurgical compositions comprising an iron-based metallurgical powder; an iron-copper prealloy, wherein the amount of copper in the iron-copper pre-alloy is between about 1 and 20 weight percent (wt. %), based on the weight of the iron-copper pre-alloy; and copper powder.

Iron-based metallurgical powders of the invention will typically comprise an iron powder that is at least 30 wt. % iron, by weight of the iron-based metallurgical powder. Iron powders that are at least 35 wt. %, 40 wt. %, 45 wt. %, 50 wt. %, 55 wt. %, 60 wt. %, 65 wt. %, 70 wt. %, 80 wt. %, 85 wt. %, 90 wt. %, 95 wt. % iron and 99 wt. % iron, by weight of the iron-based metallurgical powder, are also within the scope of the invention.

Substantially pure iron powders that are used in the invention are powders of iron containing not more than about 1.0 wt. % by weight, preferably no more than about 0.5 wt. % by weight, of normal impurities. Examples of such highly compressible, metallurgical-grade iron powders are the ANCORSTEEL 1000 series of pure iron powders, e.g. 1000, 1000B, and 1000C, available from Hoeganaes Corporation, Riverton, N.J. For example, ANCORSTEEL 1000 iron powder, has a typical screen profile of about 22% by weight of the particles below a No. 325 sieve (U.S. series) and about 10% by weight of the particles larger than a No. 100 sieve with the remainder between these two sizes (trace amounts larger than No. 60 sieve). The ANCORSTEEL 1000 powder has an apparent density of from about 2.85-3.00 g/cm$^3$, typically 2.94 g/cm$^3$. Other iron powders that are used in the invention are typical sponge iron powders, such as Hoeganaes' ANCOR MH-100 powder and ANCORSTEEL AMH, which is an atomized low apparent density iron powder. It is preferred that the iron powders for use in the invention not include any copper; however, some copper may be present. For example, iron powders used in the invention may include up to about 0.25 weight percent of copper, based on the weight of the iron powder. Some iron powders may include up to 0.1 weight percent copper, based on the weight of the iron powder. The trace amount of copper that may be present in the iron-based powder is not considered within the scope of the invention to be a source of "iron-copper prealloy" or "copper powder," as those terms are used herein.

A further example of iron-based powders for use in the invention are diffusion-bonded iron-based powders which are particles of substantially pure iron that have a layer or coating of one or more other alloying elements or metals, such as steel-producing elements, diffused into their outer surfaces. A typical process for making such powders is to atomize a melt of iron and then combine this atomized powder with the alloying powders and anneal this powder mixture in a furnace. Such commercially available powders include DISTALOY 4600A diffusion bonded powder from Hoeganaes Corporation, which contains about 1.8% nickel, about 0.55% molybdenum, and about 1.6% copper, and DISTALOY 4800A diffusion bonded powder from Hoeganaes Corporation, which contains about 4.05% nickel, about 0.55% molybdenum, and about 1.6% copper. In those embodiments employing a diffusion-bonded iron based powder that includes copper, it is within the scope of the invention that at least a portion of the copper present in the diffusion-bonded iron powder is considered to be a source of "copper powder," as that term is used herein.

The particles of the iron-based metallurgical powder can have an average particle diameters as small as about 5 micron or up to about 850 to 1,000 microns, but generally the particles will have an average diameter in the range of about 10 to 500 microns or about 5 to about 400 microns, or about 5 to about 200 microns. Measurement of the average particle diameter can be performed using laser diffraction techniques known in the art.

In preferred embodiments of the invention, the combination of iron-copper prealloy and copper powder will result in a powder metallurgical composition including about 0.5 to about 2.5 wt. % of copper, preferably 1.5 to about 2.5 wt. % of copper, based on the weight of the composition. In other embodiments, the combination of iron-copper prealloy and copper powder will result in a powder metallurgical composition including about 0.5 to about 2.0 wt. % of copper, based on the weight of the composition. In still other embodiments, the combination of iron-copper prealloy and copper powder will result in a powder metallurgical composition including about 1 to about 2.0 wt. % of copper, preferably about 1 wt. % of copper, based on the weight of the composition. In yet other embodiments, the combination of iron-copper prealloy and copper powder will result in a powder metallurgical composition including about 1.5 to about 2.0 wt. % of copper, based on the weight of the composition. It is preferred that the combination of iron-copper prealloy and copper powder will result in a powder metallurgical composition including about 2 to about 2.5 wt. % of copper, based on the weight of the composition.

As used herein, an "iron-copper prealloy" is a composition prepared by alloying copper with iron in the molten state, where the molten alloy is thereafter formed into a powder, such as by water atomization and annealing to produce a powder. Such prealloys can include about 1 to about 20 wt. % of copper, based on the weight of the prealloy. In preferred embodiments, the prealloys of the invention will include about 1 to about 15 wt. % of copper, based on the weight of the prealloy. In other embodiments, the prealloys of the invention will include about 1 to about 10 wt. % of copper, based on the weight of the prealloy. In yet other embodiments, the prealloys of the invention will include about 1 to about 8 wt. % of copper, based on the weight of the prealloy. In still other embodiments, the prealloys of the invention will include about 1 to about 5 wt. % of copper, based on the weight of the prealloy.

It is preferable that the iron-copper prealloy have a similar particle size distribution to the iron powder. For example, if the particles of the iron-based metallurgical powder have an average particle diameters of about 5 to about 200 microns, the particles of the iron-copper prealloy will also have an average particle diameter of about 5 to about 200 microns. Measurement of the average particle diameter can be performed using laser diffraction techniques known in the art.

As used herein, "copper powder" refers to elemental copper powder that is known in the art and is available from commercial sources. The copper powder of the invention is admixed into the powder metallurgical compositions of the invention and is not intended to encompass any copper that may inherently be present in the iron-based powders used in the invention. Copper powders used in the invention are substantially pure copper powders comprising at least 99% copper, by weight of the copper powder.

In preferred powder metallurgical compositions of the invention with comprise from about 0.5 to about 2 wt. % of copper powder, based on the weight of the composition. In other embodiments, the powder metallurgical compositions of the invention with comprise from about 0.5 to about 1.5 wt. % of copper powder, based on the weight of the composition. In still other embodiments, the powder metallurgical compositions of the invention with comprise from about 0.5 to about 1 wt. % of copper powder, based on the weight of the composition. Particularly preferred embodiments will comprise about 1 wt. % of copper powder, based on the weight of the composition.

Preferred copper powders of the invention will have an average particle diameter of less than about 200 microns. Also preferred are copper powders having an average particle diameter of less than about 20 microns. Most preferred are those copper powders having an average particle diameter of less than about 100 microns. Measurement of the average particle diameter can be performed using laser diffraction techniques known in the art.

It will be readily apparent to the skilled person that once a target amount of total copper to be present in the powder metallurgical composition is determined, any combination of copper powder and iron-copper prealloy that achieves that target amount of total copper is within the scope of the invention.

Powder metallurgical compositions of the invention may also include graphite (i.e, carbon), in an amount up to about 2 wt. % graphite, based on the weight of the powder metallurgical composition. Preferred compositions will include graphite in an amount up to about 1.5 wt. % graphite, based on the weight of the powder metallurgical composition. Other compositions within the scope of the invention will include graphite in an amount up to about 1 wt. % graphite, based on the weight of the powder metallurgical composition. Still other compositions within the scope of the invention will include graphite in an amount up to about 0.5 wt. % graphite, based on the weight of the powder metallurgical composition. Typical compositions within the scope of the invention will comprise from about 0.1% to about 1 wt. % of graphite, based on the weight of the powder metallurgical composition.

Pre-lubricating the die wall and/or admixing lubricants in the metallurgical powder facilitates ejection of compacted parts from a die by and also assists the re-packing process by lubricating the particles of the powder. Preferred lubricants suitable for use in PM are well known to those skilled in the art and include, for example, ethylene-bis-stearamide (EBS) (e.g., ACRAWAX C, Lonza, Chagrin Falls, Ohio), and zinc stearate. Examples of lubricants that can be used in the invention include other stearate compounds, such as lithium, manganese, and calcium stearates, other waxes such as polyethylene wax, and polyolefins, and mixtures of these types of lubricants. Other lubricants include those containing a polyether compound such as is described in U.S. Pat. No. 5,498,276 to Luk, and those useful at higher compaction temperatures described in U.S. Pat. No. 5,368,630 to Luk, in addition to those disclosed in U.S. Pat. No. 5,330,792 to Johnson et al., each of which is incorporated herein in its entirety by reference.

Binders can also be included in the compositions of the invention, including, for example, polyethylene oxide (e.g., ANCORBOND II, Hoeganaes Corp., Riverton, N.J.) and polyethylene glycol, e.g., polyethylene glycol having an average molar mass of about 3000 to about 35,000 g/mol. Other binders suitable for use in powder metallurgical applications are known in the art.

Compacted and sintered parts can be prepared from the compositions herein described using standard techniques known in the art. For example, the compositions of the invention can be compacted in a die. Typical compaction pressures are at least about 25 tsi and can be up to about 200 tsi, with about 40-60 tsi being used most commonly. The resulting green compact can then be sintered at about 2050° F. (1120° C.). In double-press compaction techniques, after an initial compaction, the resultant green compact is annealed at about 1355° F. (735° C.) to about 1670° F. (910° C.), followed by a second compaction. After the second compaction, the compact is sintered. Annealing and sintering can be accomplished under conventional atmospheres, for example, nitrogen-hydrogen atmospheres.

The invention is further described by reference to the following examples. These examples are intended to be illustrative only, and are not intended to be limiting of the invention.

EXAMPLES

Materials

ANCORSTEEL 1000B, 1000BMn, and 1000C (Hoeganaes Corp., Riverton, N.J.) was used in Examples 1, 2, and 3, respectively. ACUPOWDER 8081 copper powder was purchased from ACuPowder Int'l, LLC, Union, N.J. Graphite powder was purchased from Asbury Carbons, Asbury, N.J.

Example 1

In this example, iron-based powder compositions comprising about 2 wt. % copper and about 0.7% graphite, by weight of the powder composition, were prepared. Powder 1 incorporated the copper via an iron-copper diffusion alloy. As used herein, an iron-copper "diffusion alloy" is an alloy made by metallurgically bonding copper to the outside of iron particles. Typically, such diffusion alloys will include about 10% to about 20% by weight copper, based on the weight of the alloy. Powder 2 incorporated the copper via an iron-copper prealloy. A third powder comprising iron and graphite, with no copper, was also prepared as a control. All three powder mixtures were compacted to a 6.9 g/cm$^3$ green density and sintered at 1120° C. in 90% nitrogen-10% hydrogen atmosphere. The sinter properties of these three powders is set forth in Table 1.

Powder 1: pre-mix of iron, 10% addition of iron-copper diffusion alloy (20 wt. % copper, based on the weight of the diffusion alloy), 0.7% graphite, 0.75% EBS lubricant. Final composition: iron, about 2% copper, about 0.7% graphite Powder 2: pre-mix of iron, 10% addition of iron-copper prealloy (20 wt. % copper, based on the weight of the prealloy), 0.7% graphite, 0.75% EBS lubricant. Final composition: iron, about 2% copper, about 0.7% graphite Powder 3: pre-mix of iron and 0.7% graphite, 0.75% EBS lubricant.

TABLE 1

Sinter properties of compacts made with powders 1-3.

| | Sinter Properties | | | | |
|---|---|---|---|---|---|
| 6.9 g/cm$^3$ | Compaction Pressure (TSI) | Sinter Density (g/cm$^3$) | TRS (ksi) | DC (%) | Hardness (HRA) |
| Powder #1 | 32.4 | 6.80 | 132 | 0.45 | 43 |
| Powder #2 | 32.4 | 6.85 | 112 | 0.23 | 42 |
| Powder #3 | 32.2 | 6.85 | 87 | 0.24 | 31 |

As can be seen in Table 1, the use of the iron-copper prealloy (powder #2) greatly reduced the dimensional change (DC) of the composition as compared to the powder including the iron-copper diffusion alloy (powder #1). The dimensional change exhibited using the iron-copper prealloy approached the dimensional change observed with the composition including no copper (powder #3). The final density using the iron-copper prealloy is higher than that seen with the diffusion alloy, with little affect on compressibility.

Example 2

Sets of iron-based powder compositions each comprising about 1.8 wt. % copper were prepared. One set of powder compositions (Powder #s 4A, 4B, 4C) included the copper only as copper powder. Another set of powder compositions (Powder #s 5A, 5B, 5C) included the copper as a combination of copper powder and iron-copper prealloy. The final set of powder composition (Powder #s 6A, 6B, 6C) included the copper only as an iron-copper prealloy. Graphite content was varied within each set of powders. All PM mixtures contained about 0.7 wt. % EBS as a lubricant.

Figure 2:
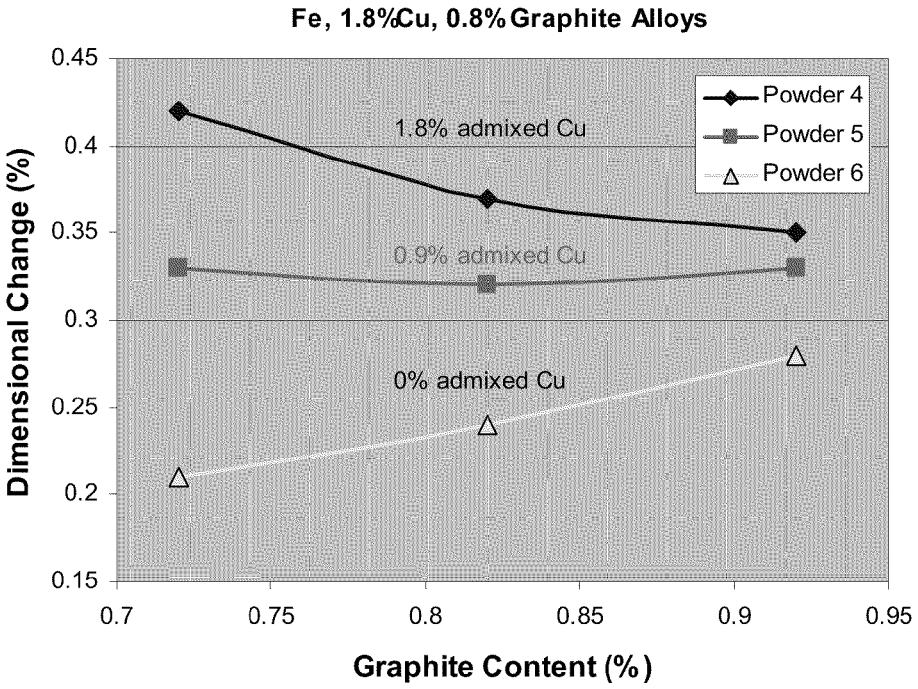
FIG. 2 depicts the dimensional change observed with varying graphite content for three different mixtures of iron-copper (1.8 wt. %)-graphite.

Transverse rupture strength bars were pressed to 6.9 g/cm$^3$ green density and sintered at 1120° C. in a belt furnace using a 90% nitrogen-10% hydrogen atmosphere. Dimensional change was measured by comparing the sintered length of the bar to the length of the die used to compact the bars. The results of the tests are depicted in FIG. 2.

Powder Set #4

Powder 4A: prepared by admixing iron with copper powder (1.8%)+0.8% graphite and 0.7% EBS lubricant.

Powder 4B: prepared by admixing iron with copper powder (1.8%)+0.9% graphite and 0.7% EBS lubricant.

Powder 4C: prepared by admixing iron with copper powder (1.8%)+0.7% graphite and 0.7% EBS lubricant.

Powder Set #5

Powder 5A: prepared using a combination of iron admixed with prelloyed iron-copper and copper powder+0.8% graphite and 0.7% EBS lubricant.

Powder 5B: prepared using a combination of iron admixed with prelloyed iron-copper and copper powder+0.9% graphite and 0.7% EBS lubricant Powder 5C: prepared using a combination of iron admixed with prelloyed iron-copper and copper powder+0.7% graphite and 0.7% EBS lubricant Powder Set #6

Powder 6A: iron admixed with iron-copper prealloy powder (3 wt. % Cu)+0.8% graphite and 0.7% EBS lubricant.

Powder 6B: iron admixed with iron-copper prealloy powder (3 wt. % Cu)+0.9% graphite and 0.7% EBS lubricant.

Powder 6C: iron admixed with iron-copper prealloy powder (3 wt. % Cu)+0.7% graphite and 0.7% EBS lubricant.

Materials where the copper is included via a combination of iron-copper prealloy and copper powder (Powder #5), resulted in very good dimensional consistency with respect to variations in graphite content. Dimensional change is essentially constant as graphite content changes in Powder #5. This is in contrast to the materials wherein copper is included solely as copper powder (Powder #4) where significant dimensional variations were observed with varying amounts of graphite content.

The mechanical properties for Powders 4A, 5A, and 6A (all having about 0.8 wt. % graphite) are depicted in Table 2. The hardness of each of the compacts is maintained with the use of the iron-copper prealloy.

TABLE 2

Sinter properties of compacts made with powders 4-6.

| | Sinter Properties | | | | |
|---|---|---|---|---|---|
| 6.9 g/cm$^3$ | Compaction Pressure (TSI) | Sinter Density (g/cm$^3$) | TRS (ksi) | DC (%) | Hardness (HRA) |
| Powder #4 | 32.4 | 6.80 | 135 | 0.37 | 47 |
| Powder #5 | 35.6 | 6.81 | 128 | 0.32 | 48 |
| Powder #6 | 38.6 | 6.83 | 117 | 0.24 | 47 |

Example 3

Sets of iron-based powder compositions each comprising about 2 wt. % copper were prepared. One set of powder compositions (Powder #s 7A, 7B, 7C) included the copper only as copper powder. Another set of powder compositions (Powder #s 8A, 8B, 8C) included the copper as a combination of copper powder and iron-copper prealloy. The final set of powder composition (Powder #s 9A, 9B, 9C) included the copper only as an iron-copper prealloy. Graphite content was varied within each set of powders. All PM mixtures contained about 0.75 wt. % EBS as a lubricant.

Figure 3:
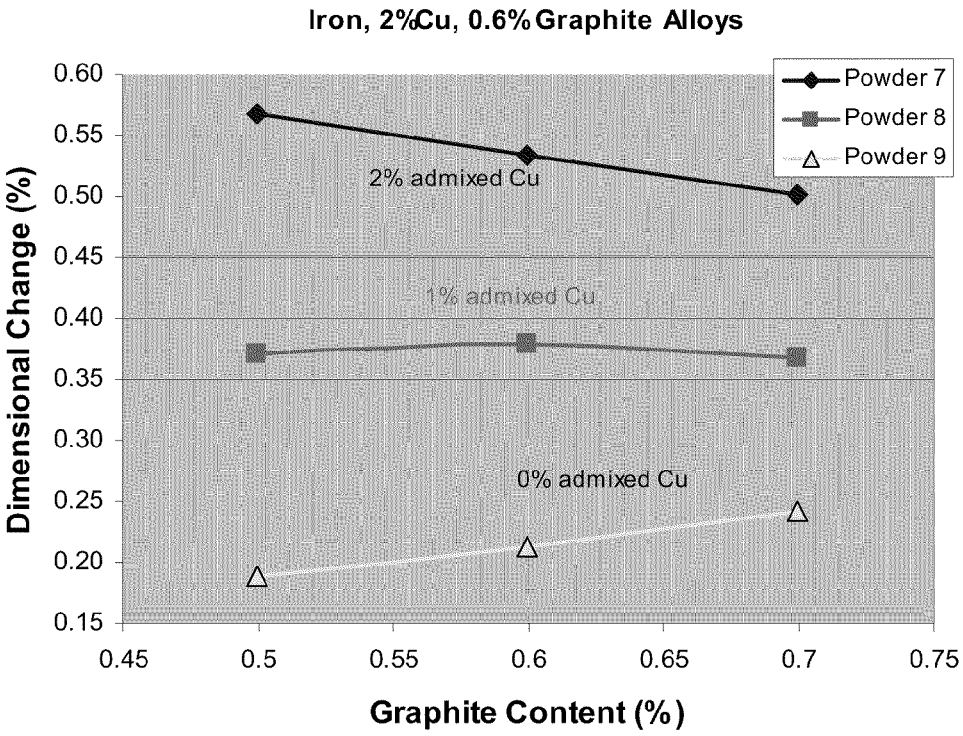
FIG. 3 depicts the dimensional change observed with varying graphite content for three different mixtures of iron-copper (2 wt. %)-graphite.

Transverse rupture strength bars were pressed to 6.9 g/cm$^3$ green density and sintered at 1120° C. in a belt furnace using a 90% nitrogen-10% hydrogen atmosphere. Dimensional change was measured by comparing the sintered length of the bar to the length of the die used to compact the bars. The results of the tests are depicted in FIG. 3.

Powder Set #7

Powder 7A: prepared by admixing iron with copper powder (2%)+0.6% graphite and 0.75% EBS lubricant.

Powder 7B: prepared by admixing iron with copper powder (2%)+0.7% graphite and 0.75% EBS lubricant.

Powder 7C: prepared by admixing iron with copper powder (2%)+0.5% graphite and 0.75% EBS lubricant.

Powder Set #8

Powder 8A: prepared using a combination of iron admixed with prelloyed iron-copper and copper powder+0.6% graphite and 0.75% EBS lubricant.

Powder 8B: prepared using a combination of iron admixed with prelloyed iron-copper and copper powder+0.7% graphite and 0.75% EBS lubricant Powder 8C: prepared using a combination of iron admixed with prelloyed iron-copper and copper powder+0.5% graphite and 0.75% EBS lubricant Powder Set #9

Powder 9A: iron admixed with iron-copper prealloy powder (3 wt. % Cu)+0.6% graphite and 0.75% EBS lubricant.

Powder 9B: iron admixed with iron-copper prealloy powder (3 wt. % Cu)+0.7% graphite and 0.75% EBS lubricant.

Powder 9C: iron admixed with iron-copper prealloy powder (3 wt. % Cu)+0.5% graphite and 0.75% EBS lubricant.

Materials where the copper is included via a combination of iron-copper prealloy and copper powder (Powder #8), resulted in very good dimensional consistency with respect to variations in graphite content. Dimensional change is essentially constant as graphite content changes in Powder #8. This is in contrast to the materials wherein copper is included solely as copper powder (Powder #7) where significant dimensional variations were observed with varying amounts of graphite content.

The mechanical properties for Powders 7A, 8A, and 9A (all having about 0.6 wt. % graphite) are depicted in Table 3. The hardness of each of the compacts is maintained with the use of the iron-copper prealloy.

TABLE 3

Sinter properties of compacts made with powders 7-9.

| | Sinter Properties | | | | |
|---|---|---|---|---|---|
| 7.0 g/cm$^3$ | Compaction Pressure (TSI) | Sinter Density (g/cm$^3$) | TRS (ksi) | DC (%) | Hardness (HRA) |
| Powder #7 | 32.8 | 6.85 | 132 | 0.53 | 45 |
| Powder #8 | 38.4 | 6.91 | 122 | 0.38 | 46 |
| Powder #9 | 43.8 | 6.96 | 113 | 0.21 | 45 |

Figure 4:
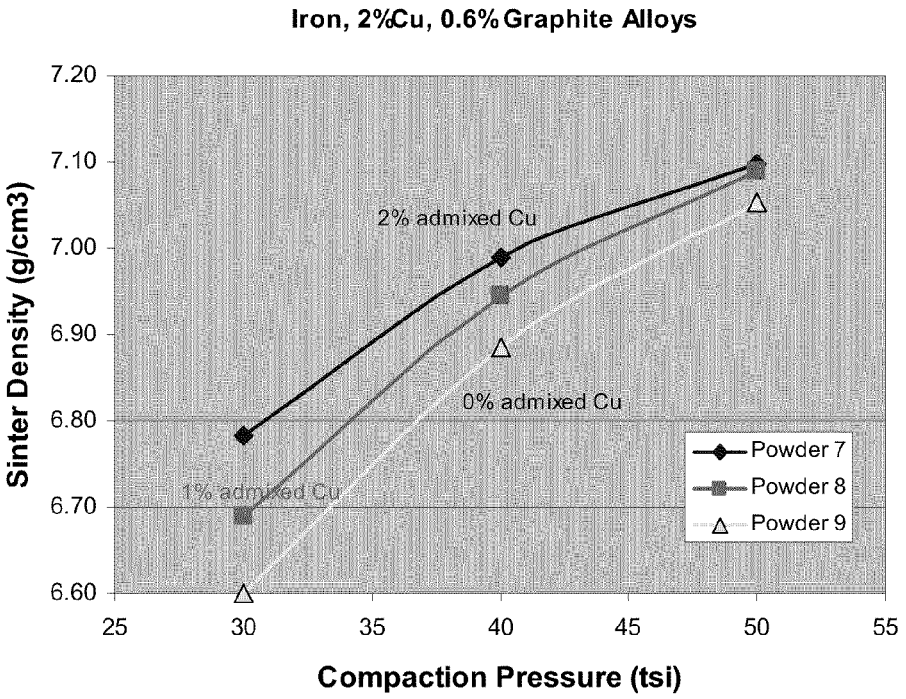
FIG. 4 depicts compaction pressure vs. sintered density for Powders 7A, 8A, and 9A.

The compaction pressure required to achieve a 7.0 g/cm$^3$ green density increases with the amount of iron-copper prealloy, although the sintered density also increases as less growth occurs during sintering. The difference in required compaction pressure to achieve a given sintered density is depicted in FIG. 4. As shown in FIG. 4, Powder 8A shows significantly less density loss at a given compaction pressure as compared to Powder 9A. Surprisingly, the required compaction pressure to achieve a 7.1 g/cm$^3$ sintered density is similar for Powders 7A and 8As.

What is claimed:

1. A powder metallurgical composition comprising:

an iron-based metallurgical powder, which is at least 80 weight percent iron;

an iron-copper prealloy, wherein the amount of copper in the iron-copper pre-alloy is between about 1 and 5 weight percent, based on the weight of the iron-copper prealloy;

at least about 0.5 weight percent of elemental copper powder, based on the weight of the composition; and about 0.1 to about 2 weight percent of graphite;

wherein the iron-copper prealloy and the elemental copper powder provide about 1.8 to about 2 weight percent of total copper to the composition.

2. The powder metallurgical composition of claim 1 wherein the composition comprises at least about 30 weight percent of the iron-based metallurgical powder, based on the total weight of the powder metallurgical composition.

3. The powder metallurgical composition of claim 1 wherein the composition comprises at least about 40 weight percent of the iron-based metallurgical powder, based on the total weight of the powder metallurgical composition.

4. The powder metallurgical composition of claim 1 comprising about 0.5 to about 1.5 weight percent of elemental copper powder, based on the weight of the composition.

5. The powder metallurgical composition of claim 1 comprising about 1 weight percent of elemental copper powder, based on the weight of the composition.

6. The powder metallurgical composition of claim 1 wherein the iron-copper prealloy and the elemental copper powder provide about 1.8 weight percent of total copper to the composition.

7. The powder metallurgical composition of claim 1, wherein the composition comprises from about 0.1 to about 1 weight percent of graphite, based on the weight of the composition.

8. The powder metallurgical composition of claim 1, further comprising a lubricant.

9. The powder metallurgical composition of claim 8, wherein the lubricant is ethylene-bis-stearate.

10. The powder metallurgical composition of claim 1, wherein the average diameter of the particles of the prealloy is substantially the same as the average diameter of the particles of the iron powder.

11. The powder metallurgical composition of claim 1, wherein the iron-copper prealloy and the elemental copper powder provide about 2 weight percent of total copper to the composition.

12. A sintered powder metallurgical part prepared using the composition of claim 1.

* * * * *